US007152409B2

(12) United States Patent
Yee et al.

(10) Patent No.: US 7,152,409 B2
(45) Date of Patent: Dec. 26, 2006

(54) DYNAMIC CONTROL SYSTEM AND METHOD FOR MULTI-COMBUSTOR CATALYTIC GAS TURBINE ENGINE

(75) Inventors: David K. Yee, Hayward, CA (US); Dag Reppen, Chandler, AZ (US)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 148 days.

(21) Appl. No.: 10/758,879

(22) Filed: Jan. 16, 2004

(65) Prior Publication Data

US 2004/0206091 A1 Oct. 21, 2004

Related U.S. Application Data

(60) Provisional application No. 60/440,940, filed on Jan. 17, 2003.

(51) Int. Cl.
*F02C 9/00* (2006.01)
*F23R 3/40* (2006.01)

(52) U.S. Cl. ..... 60/777; 60/39.281; 60/723; 431/7

(58) Field of Classification Search ..... 60/39.27, 60/39.281, 723, 777; 431/7, 170
See application file for complete search history.

(56) References Cited

U.S. PATENT DOCUMENTS

| | | | | |
|---|---|---|---|---|
| 3,846,979 | A | 11/1974 | Pfefferle | |
| 3,928,961 | A | 12/1975 | Pfefferle | |
| 3,975,900 | A | 8/1976 | Pfefferle | |
| 4,473,536 | A | 9/1984 | Carberg et al. | |
| 4,534,165 | A | 8/1985 | Davis, Jr. et al. | |
| 4,726,181 | A * | 2/1988 | Pillsbury | 60/777 |
| 4,794,753 | A | 1/1989 | Beebe | |
| 5,133,180 | A | 7/1992 | Horner et al. | |
| 5,139,755 | A | 8/1992 | Seeker et al. | |
| 5,161,366 | A | 11/1992 | Beebe | |
| 5,165,224 | A | 11/1992 | Spadaccini et al. | |
| 5,183,401 | A | 2/1993 | Dalla Betta et al. | |
| 5,232,357 | A | 8/1993 | Dalla Betta et al. | |
| 5,235,804 | A | 8/1993 | Colket, III et al. | |
| 5,248,251 | A | 9/1993 | Dalla Betta et al. | |
| 5,250,489 | A | 10/1993 | Dalla Betta et al. | |
| 5,258,349 | A | 11/1993 | Dalla Betta et al. | |
| 5,259,754 | A | 11/1993 | Dalla Betta et al. | |
| 5,263,325 | A | 11/1993 | McVey et al. | |
| 5,269,679 | A | 12/1993 | Syska et al. | |
| 5,281,128 | A | 1/1994 | Dalla Betta et al. | |
| 5,318,436 | A | 6/1994 | Colket, III et al. | |
| 5,395,235 | A | 3/1995 | Lan-Sun Hung | |

(Continued)

FOREIGN PATENT DOCUMENTS

| | | |
|---|---|---|
| EP | 0 453 178 | 10/1991 |

(Continued)

OTHER PUBLICATIONS

U.S. Appl. No. 10/071,749, filed Feb. 7, 2002, Yee et al.

(Continued)

*Primary Examiner*—L. J. Casaregola
(74) *Attorney, Agent, or Firm*—Morrison & Foerster LLP

(57) ABSTRACT

According to one aspect, a method of controlling a multi-combustor catalytic combustion system is provided for determining a characteristic of a fuel-air mixture downstream of a preburner associated with a catalytic combustor and adjusting the fuel flow to the preburner based on the characteristic. The characteristic may include, for example, a measurement of the preburner or catalyst outlet temperature or a determination of the position of the homogeneous combustion wave in the burnout zone of the combustor.

32 Claims, 12 Drawing Sheets

U.S. PATENT DOCUMENTS 5,405,260 A 4/1995 Della Betta et al.
5,413,477 A 5/1995 Moreland
5,425,632 A 6/1995 Kazunori et al.
5,452,574 A 9/1995 Cowell et al.
5,461,855 A 10/1995 Inoue et al.
5,461,864 A 10/1995 Betta et al.
5,474,441 A 12/1995 Farrauto et al.
5,511,972 A 4/1996 Dalla Betta et al.
5,512,250 A 4/1996 Betta et al.
5,551,869 A 9/1996 Brais et al.
5,554,021 A 9/1996 Robertson et al.
5,569,020 A 10/1996 Griffin et al.
5,581,997 A 12/1996 Janes
5,634,784 A 6/1997 Pfefferle et al.
5,729,967 A 3/1998 Joos et al.
5,826,429 A 10/1998 Beebe et al.
5,850,731 A 12/1998 Beebe et al.
5,879,148 A 3/1999 Cheng et al.
5,896,738 A 4/1999 Yang et al.
5,913,675 A 6/1999 Vago et al.
5,937,632 A 8/1999 Döbbeling et al.
5,937,634 A 8/1999 Etheridge et al.
5,957,682 A 9/1999 Kamal et al.
5,965,001 A 10/1999 Chow et al.
5,985,222 A 11/1999 Sudduth et al.
6,000,212 A 12/1999 Kolaczkowski et al.
6,038,861 A 3/2000 Amos et al.
6,066,303 A 5/2000 Sudduth et al.
6,082,111 A 7/2000 Stokes
6,089,855 A 7/2000 Becker et al.
6,094,916 A 8/2000 Puri et al.
6,095,793 A 8/2000 Greeb
6,105,360 A 8/2000 Willis
6,109,018 A 8/2000 Rostrup-Nielsen et al.
6,116,014 A 9/2000 Dalla Betta et al.
6,122,916 A 9/2000 Amos et al.
6,125,625 A 10/2000 Lipinski et al.
6,128,894 A 10/2000 Joos et al.
6,201,029 B1 3/2001 Waycuilis
6,217,832 B1 4/2001 Betta et al.
6,226,977 B1 5/2001 Ichiryu et al.
6,237,343 B1 5/2001 Butler
6,250,877 B1 6/2001 Westphal et al.
6,270,336 B1 8/2001 Terashima et al.
6,280,695 B1 8/2001 Lissianski et al.
6,286,482 B1 9/2001 Flynn et al.
6,289,667 B1 9/2001 Kolaczkowski et al.
6,298,654 B1 10/2001 Vermes et al.
6,339,925 B1 1/2002 Hung et al.
6,595,003 B1 7/2003 Dalla Betta et al.
6,796,129 B1 9/2004 Yee et al.
2001/0046650 A1 11/2001 Smith et al.
2002/0056276 A1 5/2002 Dalla Betta et al.
2002/0083715 A1 7/2002 Dalla Betta et al.

FOREIGN PATENT DOCUMENTS

JP 63163716 7/1988
WO WO 03/021150 3/2003
WO WO-2004/065777 A2 8/2004

OTHER PUBLICATIONS

Felder, R.M. and Rousseau, R.W. (1978). "Adiabatic Flame Temperature," Section 10.6b in Chapter 10 *In Elementary Principles of Chemical Processes*. John Wiley & Sons, Inc.: New York, p. 414.
Lefebvre, A. H. (1998). *Gas Turbine Combustion* Hemisphere Publishing Corporation, pp. v-xiv. (Table of Contents), p. 48 (Fig. 2.7), p. 49, and p. 192 (Fig. 6.13).
Vatcha, S. R. (1997). "Low-Emission Gas Turbines Using Catalytic Combustion," *Energy Conversion and Management* 38(10-13):1327-1334.
International Search Report for PCT Application No. PCT/US04/01238 filed Jan. 15, 2004 and mailed on Feb. 24, 2005, 4 pages.

* cited by examiner

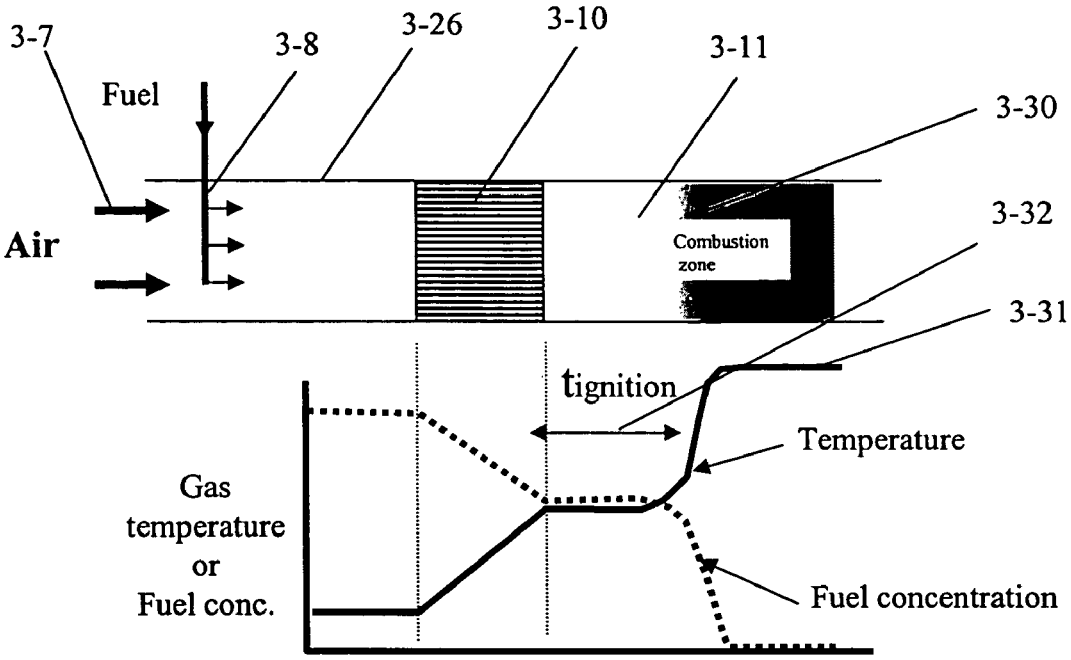
FIG. 3
Fig. 4A
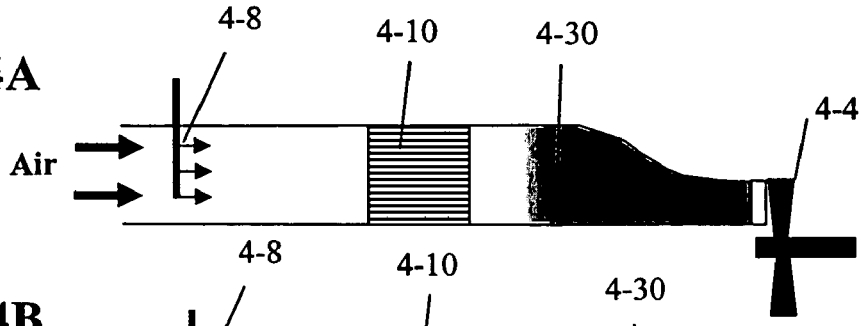
Fig. 4B
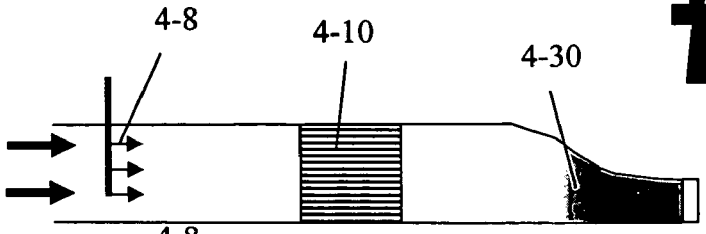
Fig. 4C
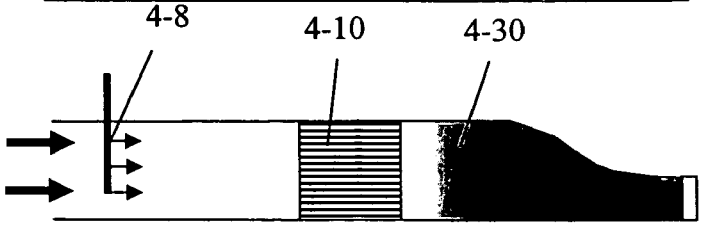

DYNAMIC CONTROL SYSTEM AND METHOD FOR MULTI-COMBUSTOR CATALYTIC GAS TURBINE ENGINE

CROSS REFERENCE TO RELATED APPLICATION

The present application claims benefit of earlier filed provisional patent application, U.S. application Ser. No. 60/440,940, filed on Jan. 17, 2003, and entitled "DYNAMIC CONTROL SYSTEM AND METHOD FOR MULTI-COMBUSTOR CATALYTIC GAS TURBINE ENGINE," which is hereby incorporated by reference as if fully set forth herein.

BACKGROUND

1. Field of the Invention

The invention relates generally to combustion control systems, and more particularly to dynamic control systems and methods for use with multi-combustor processes as they relate to and are utilized by gas turbine engines with catalytic combustors.

2. Description of the Related Art

In a conventional gas turbine engine, the engine is controlled by monitoring the speed of the engine and adding a proper amount of fuel to control the engine speed. Specifically, should the engine speed decrease, fuel flow is increased causing the engine speed to increase. Similarly, should the engine speed increase, fuel flow is decreased causing the engine speed to decrease. In this case, the engine speed is the control variable or process variable monitored for control.

A similar engine control strategy is used when the gas turbine is connected to an AC electrical grid in which the engine speed is held constant as a result of the coupling of the generator to the grid frequency. In such a case, the total fuel flow to the engine may be controlled to provide a given power output level or to run to maximum power with such control based on controlling exhaust gas temperature, turbine inlet temperature, or some other engine fundamental. Again, as the control variable rises above a set point, the fuel is decreased. Alternatively, as the control variable drops below the set point, the fuel flow is increased. This control strategy is essentially a feedback control strategy with the fuel control valve varied based on the value of a control or process variable compared to a set point.

In a typical non-catalytic combustion system using a diffusion flame burner or a simple lean premixed burner, the combustor has only one fuel injector. In such systems, a single valve is typically used to control the fuel flow to the engine. In more recent lean premix systems however, there may be two or more fuel flows to different parts of the combustor, with such a system thus having two or more control valves. In such systems, closed loop control may be based on controlling the total fuel flow based on the required power output of the gas turbine while fixed (pre-calculated) percentages of flow are diverted to the various parts of the combustor. In addition, the desired fuel split percentages between the various fuel pathways (leading to various parts of the combustor) may either be a function of certain input variables or they may be based on a calculation algorithm using process inputs such as temperatures, airflow, pressures, and the like. Such control systems offer ease of control due primarily to the very wide operating ranges of these conventional combustors and the ability of the turbine to withstand short spikes of high temperature without damage to various turbine components. Moreover, the fuel/air ratio fed to these combustors may advantageously vary over a wide range with the combustor remaining operational.

The configuration of industrial gas turbines with conventional, non-catalytic combustors, varies from simple single-silo configurations, i.e., one combustor as discussed above, to multiple-combustor configurations. The application of industrial, or otherwise, gas turbine engines with catalytic combustion, however, has been limited to the single-silo configuration. For example, the Kawasaki M1A-13X and the GE 10 (PGT 10B) gas turbine engines. A properly operated single-silo catalytic combustion system may provide significantly reduced emissions levels, particularly of $NO_x$ over conventional diffusion flame or lean premixed burners. Unfortunately, however, such systems may have a much more limited window of operation compared to conventional diffusion flame combustors. For example, fuel/air ratios above a certain limit may cause the catalyst to overheat and lose catalytic activity in a very short time. In addition, the catalyst inlet temperature may have to be adjusted as the engine load is changed or as ambient temperature or other operating conditions change to keep $NO_x$ production low.

The application of catalytic combustion in a multi-combustor configuration poses several additional problems. For example, in a multi-combustor configuration there typically are variations from combustor-to-combustor due to manufacturing or design differences that may lead to variations in pre-burner ignition, catalyst light-off, and/or homogeneous combustion in the burnout zone across the multiple combustors. Additionally, the combustor sizes are typically reduced to prevent combustor-to-combustor physical interference adding complexity to the design of the combustors. Combustor size reduction can be achieved through flame-holders in the burn-out zone and single-stage catalyst designs. To supplement the single stage catalyst designs, pre-burners with increased turn-down ratios are generally used. These design changes will require more complex control of the pre-burner and/or post catalyst homogenous combustion burnout zone. What is needed therefore is a method and system for controlling catalytic combustion in a multi-combustor system.

BRIEF SUMMARY OF THE INVENTION

According to one aspect, a method of controlling a multi-combustor catalytic combustion system includes determining a characteristic of a fuel-air mixture downstream of a preburner associated with a catalytic combustor and adjusting the fuel flow and/or airflow to the preburner based on the characteristic. The characteristic may include, for example, a measurement of the preburner or catalyst outlet temperature or a determination of the position of the homogeneous combustion wave in the burnout zone of the combustor.

According to another aspect, a method of controlling a multi-combustor catalytic combustion system includes the acts of determining a first characteristic of operation for at least one combustor of the system, determining a second characteristic of operation for the whole system, and controlling the system based upon feedback from the first characteristic and the second characteristic. The first characteristic may include a catalyst exit temperature or the like and the second characteristic may include a measure of CO emissions or the like.

The present invention is better understood upon consideration of the detailed description below in conjunction with the accompanying drawings and claims.

BRIEF DESCRIPTION OF THE DRAWINGS

FIG. 3 illustrates an exemplary catalytic combustion system with associated temperature and fuel concentration profiles;

FIGS. 4A, 4B, and 4C illustrate an exemplary catalytic combustion system with varying location of the post catalyst homogeneous wave;

DETAILED DESCRIPTION OF THE INVENTION

The present invention provides a catalytic multi-combustor system and associated methods of operation. The following description is presented to enable any person of ordinary skill in the art to make and use the invention. Descriptions of specific applications are provided only as examples. Various modifications to the exemplary embodiments will be readily apparent to those skilled in the art, and the general principles defined herein may be applied to other examples and applications without departing from the spirit and scope of the invention. Thus, the present invention is not intended to be limited to the examples shown, but is to be accorded the widest scope consistent with the principles and features disclosed herein.

Exemplary methods and systems are described herein for improved control strategies for an efficient application of multi-combustor catalytic combustion system configurations for gas turbine engines. Various methods described herein address issues relating to igniting and controlling multiple pre-burners associated with the combustors as well achieving uniform homogeneous combustion in the burnout zone across multiple combustors.

Figure 1:
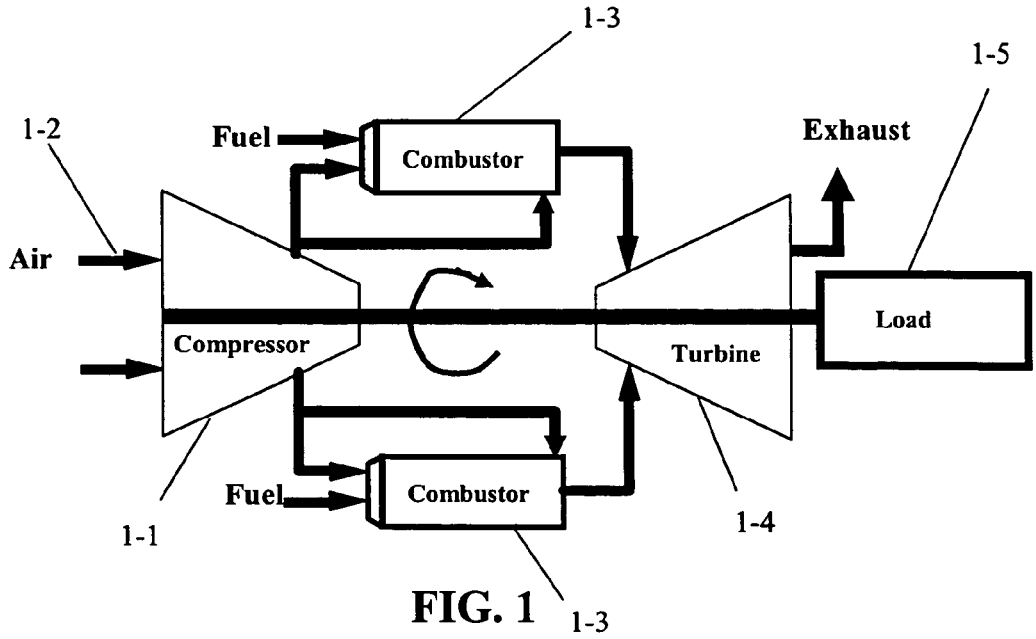
FIG. 1 illustrates an exemplary gas turbine system.

FIG. 1 schematically illustrates an exemplary catalytic multi-combustor gas turbine system. Compressor 1-1 ingests ambient air 1-2 through a compressor bellmouth, and compresses the air to a higher pressure and drives the compressed air, at least in part, through two or more combustors 1-3 and through the drive turbine 1-4. Although only two combustors 1-3 are shown, the gas turbine engine may include any number of a plurality of combustors 1-3 located about the periphery of the gas turbine as is known in the art for conventional multi-combustor gas turbine engines. Each combustor 1-3 mixes fuel and air 1-2 and combusts the mixture to form a hot, high velocity gas stream that flows through the turbine 1-4. The high velocity gas stream provides power to drive turbine 1-4 and the load 1-5. Load 1-5 may be, for example, a generator or the like.

Figure 2:
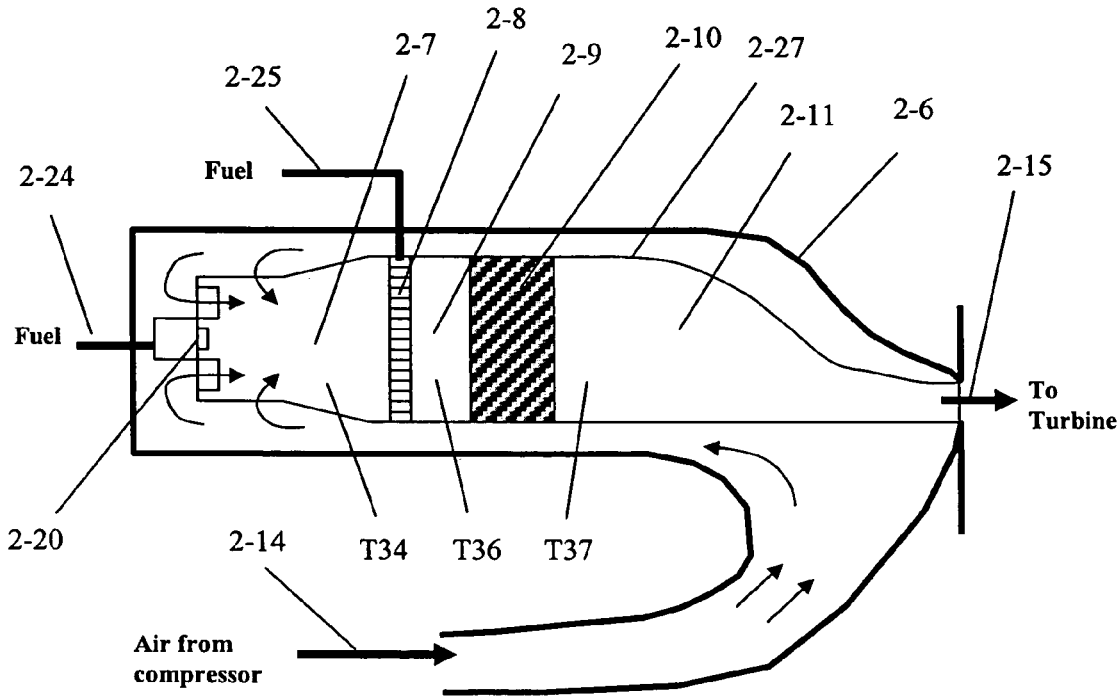
FIG. 2 illustrates an exemplary catalytic combustion system.
Figure 2A:
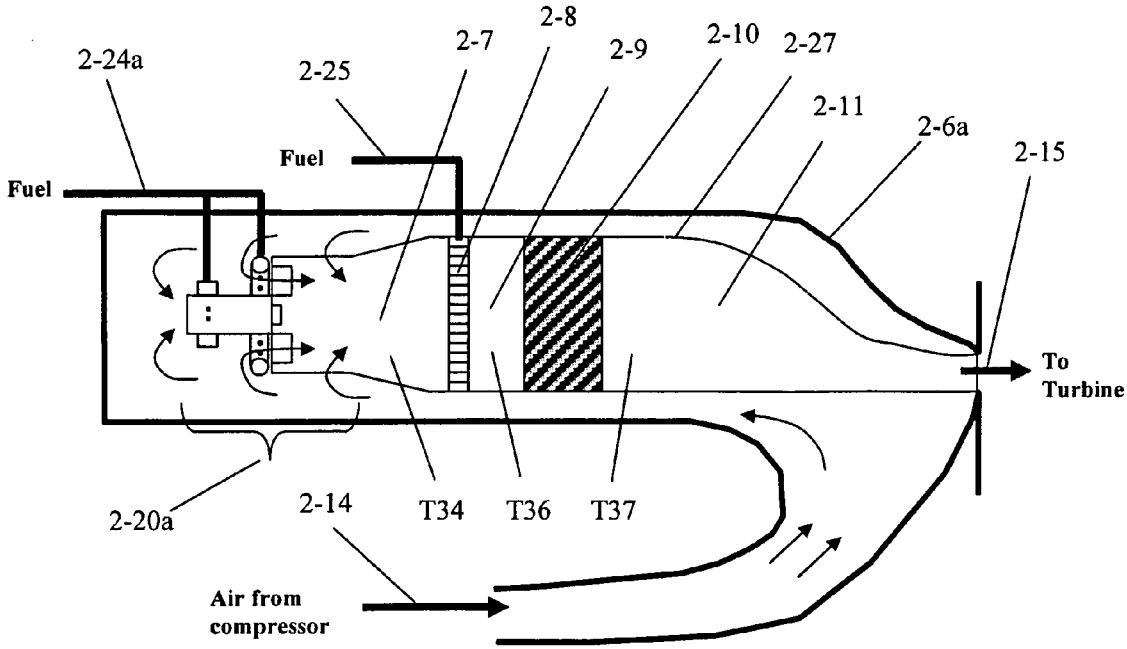
FIG. 2A illustrates an exemplary catalytic combustion system.

FIG. 2 is a close-up view of one combustor 1-3 of the multiple combustor configuration of FIG. 1. Specifically, as shown in FIG. 2, a catalytic combustor 2-6 is provided. In this example, catalytic combustor 2-6 includes four major elements that are arrayed serially in the flow path of at least a portion of the air from the compressor discharge 2-14. Specifically, these four elements include a preburner 2-20, for example a flame preburner (which is positioned upstream of the catalyst and which produces a hot gas mixture 2-7), a fuel injection and mixing system 2-8, a catalyst 2-10, and a burnout zone 2-11. The exiting hot gases from the combustion system flow into the drive turbine 2-15 to produce power that may drive a load. In one example, there are two independently controlled fuel streams, with one stream 2-24 directed to a preburner 2-20 and the other stream 2-25 being directed to the catalyst fuel injection and mixing system 2-8, as shown. Further, in some examples multiple preburner zones or fuel stages may be employed with additional independently controlled fuel streams for each fuel stage of preburner 2-20. For example. FIG. 2A illustrates an exemplary catalytic combustor 2-6*a*, which is similar to catalytic combustor 2-6 of FIG. 2 (and labeled similarly), except that catalytic combustor 2-6*a* includes a multi-stage preburner 2-20*a* having multiple fuel stream 2-24*a*, one for each stage of preburner 2-20*a*.

In one example, catalytic combustor 2-6 may generally operate in the following manner. The majority of the air from the gas turbine compressor discharge 2-14 flows through the preburner 2-20 and catalyst 2-10. Preburner 2-20 functions to help start up the gas turbine and to adjust the temperature of the air and fuel mixture prior to the catalyst 2-10 at location 2-9. For instance, preburner 2-20 heats the air and fuel mixture to a level that will support catalytic combustion of the main fuel stream 2-25, which is injected and mixed with the flame burner discharge gases (by catalyst fuel injection and mixing system 2-8) prior to entering catalyst 2-10. Preburner 2-20 may further be used to adjust the catalyst 2-10 inlet temperature by varying, for example, the fuel or air supply to the preburner 2-20. Ignition of each combustor 2-6 may be achieved by means of a spark plug or the like in conjunction with cross fire tubes (not shown) linking the various combustors 2-6 as is known in the art.

Partial combustion of the fuel/air mixture occurs in catalyst 2-10, with the balance of the combustion occurring in the burnout zone 2-11, located downstream of the exit face of catalyst 2-10. Typically, 10%–90% of the fuel is combusted in catalyst 2-10. For example, to fit the general requirements of the gas turbine operating cycle including achieving low emissions, while obtaining good catalyst durability, 20%–70% of the fuel is combusted in catalyst 2-10, and in one example between about 30% to about 60% is combusted in catalyst 2-10. In various aspects, catalyst 2-10 may consist of either a single stage (as shown) or a multiple stage catalyst including multiple catalysts 2-10 serially located within the combustor 2-6.

Reaction of any remaining fuel not combusted in the catalyst and the reaction of any remaining carbon monoxide to carbon dioxide occurs in burnout zone 2-11, thereby advantageously obtaining higher temperatures without subjecting the catalyst to these temperatures and obtaining very low levels of unburned hydrocarbons and carbon monoxide. After complete combustion has occurred in burnout zone 2-11, any cooling air or remaining compressor discharge air may be introduced into the hot gas stream at 2-15, typically located just upstream of the turbine inlet. In addition, if desired, air can optionally be introduced through liner wall 2-27 at a location close to the turbine inlet 2-15 as a means to adjust the temperature profile to that required by the turbine section at location 2-15. Such air introduction to adjust the temperature profile may be one of the design parameters for power turbine 2-15. Another reason to introduce air through liner 2-27 in the region near the turbine 2-15 would be for turbines with very low inlet temperatures at 2-15. For example, some turbines have turbine inlet temperatures in the range of 900 to 1100° C., temperatures too low to completely combust the remaining unburned hydrocarbons and carbon monoxide within the residence time of the burnout zone 2-11. In these cases, a significant fraction of the air may be diverted through the liner 2-27 in the region near turbine 2-15. This allows for a higher temperature in region 2-11 for rapid and complete combustion of the remaining fuel and carbon monoxide.

FIG. 3 illustrates an example of a typical existing partial combustion catalyst system corresponding to the system shown in FIGS. 1 and 2 and will be discussed in greater detail below. In such systems, only a portion of the fuel is combusted within the catalyst and a significant portion of the fuel is combusted downstream of the catalyst in a post catalyst homogeneous combustion zone. Further examples of partial combustion catalyst systems and approaches to their use are described in co-pending patent application and prior patents, for example: U.S. patent application Ser. No. 10/071,749 to D. Yee et al.; U.S. Pat. Nos. 5,183,401, 5,232,357, 5,250,489, and 5,281,128 to Dalla Betta et al.; and U.S. Pat. No. 5,425,632 to Tsurumi et al., all of which are incorporated herein by reference in their entirety.

I. Igniting and Controlling Multiple Pre-Burners:

Igniters located within each combustor may ignite the flame or preburner of each combustor. For example, preburner 2-20 of FIG. 2 may be ignited by an igniter (not shown) located in combustor 2-6. In other configurations, an igniter may be located in every other combustor 2-6 with cross-fire tubes disposed between combustors 2-6, or any other combination of igniters and cross-fire tubes, such that each preburner 2-20 is in physical contact with a fully ignited preburner 2-20. Confirmation of preburner 2-20 ignition may be determined by a measurement of the preburner 2-20 exit temperature with a thermocouple, a UV-sensor disposed in the preburner 2-20 "flame" region, or any other suitable method to confirm preburner ignition.

Fuel flow to the preburner 2-20 of each combustor 2-6 may be controlled during ignition of each preburner 2-20 and thereafter to control the outlet temperature of the preburner 2-20 as well as the inlet temperature of the fuel-air mixture entering the catalyst 2-10. In some examples, the preburner 2-20 of each combustor 2-6 may include more than two fuel stages adding complexity to the ignition and control process in a multi-combustor system. In one exemplary method of operation, theoretical flame temperature control is used in the first stage to control $NO_x$. Such a method is described in more detail in co-pending U.S. patent application Ser. No. 10/071,749, which is incorporated herein in its entirety by reference. The fuel flow to the third stage is limited to zero while allowing the second stage to perform closed loop temperature control up to a limit of the fuel flow, outlet temperature, pre-burner temperature rise, or theoretical flame temperature of the second stage. The secondary fuel flow (or theoretical flame temperature) may then be fixed and third stage fuel flow commenced. Closed loop temperature control may then be performed on the outlet temperature of the pre-burner 2-20 to determine fuel flow to the preburner.

In another exemplary method of operation, the total fuel flow to the preburner is based upon closed loop control on the pre-burner 2-20 outlet temperature. The total preburner fuel flow is distributed to each stage of the preburner based on an exemplary fixed fuel split schedule as shown in the table below:

| Total pre-burner fuel flow (mass/time) | First stage pre-burner | Second stage pre-burner | Third stage pre-burner |
|---|---|---|---|
| 0 | 100% | 0% | 0% |
| 100 | 100% | 0% | 0% |
| 200 | 50% | 50% | 0% |
| 300 | 33% | 67% | 0% |
| 400 | 25% | 50% | 25% |
| 500 | 20% | 40% | 60% |

It should be recognized by those skilled in the art that the above method and table are illustrative only and that other similar schedules and methods may be used within the scope of the invention to ignite and control multiple combustors. For example, different ratios for each stage may be used as well as fewer or additional preburner stages. Further, in addition to controlling the ignition process, the above methods may be used to control the catalyst inlet temperature and thereby the catalytic combustion processes downstream of the preburner.

Each preburner 2-20 of each combustor 2-26 in the multi-combustor system may similarly be controlled to ensure similar preburner outlet temperatures, catalyst inlet temperature, or catalyst outlet temperatures across the multiple combustors. Closed loop temperature control on preburner outlet temperature T34, catalyst inlet temperature T36, catalyst interstage or catalyst outlet temperature T37 (see FIG. 2) of each combustor may be used to control the preburner of each combustor through fuel valve control (of single or multiple valves for each stage), and thereby compensate for combustor-to-combustor variations within the multi-combustor system. One exemplary method for closed loop control based on catalyst outlet gas temperature T37 feedback is illustrated in FIG. 5.

Figure 5:
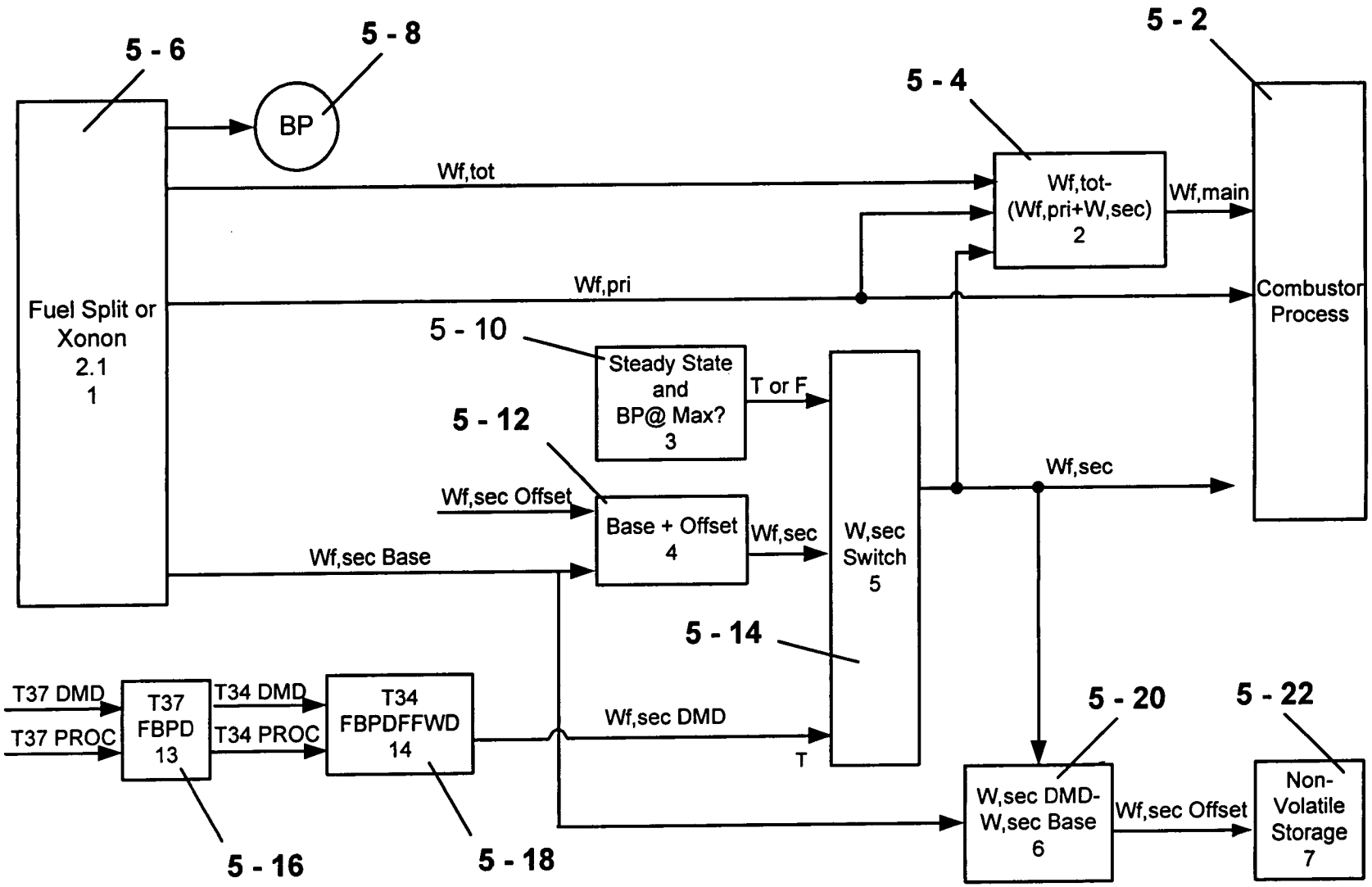
FIG. 5 illustrates an exemplary control method for a multiple combustor system.

As seen in FIG. 5, the multiple combustors of the combustor process 52 are controlled by determining a main fuel flow, i.e., to the catalyst, and a secondary fuel flow, i.e., to the preburner, from various factors such as temperature measurements, fuel flow and/or airflow calculations, and the like. In this example, a fixed fuel split schedule based on the total fuel flow to the combustor is output from block 5-6. Fuel schedules may have various schemes including fixed fuel schedules to determine fuel demand to the preburner and catalyst based on a control variable such as the engine load or the like.

Block 5-4 determines the main fuel flow Wf, main, i.e., to the catalyst, as the difference between the total fuel flow to the combustor and the sum of the respective fuel flows to the primary and secondary preburners. For example, the schedule of total fuel flow Wf, tot and fuel flow to the first stage fuel valve Wf, pri (or primary preburner) is input to block 5-4 from block 5-6. The fuel flow to the second stage fuel valve Wf,sec (or secondary preburner) determined from the output of the secondary fuel flow switch in block 5-14 (described below) is added to the primary preburner fuel flow Wf,pri.

The fuel flow to the second stage fuel valve Wf,sec is determined in block 5-14 by switching between the output of closed loop feedback control based on catalyst outlet temperature T37 from block 5-18 and a fixed offset secondary fuel demand from block 5-12. The output of block 5-14 switches between the output from block 5-12 and block 5-18 based on the output of block 5-10. Block 5-10 determines if the system is operating in a steady state and if an air bypass valve of the system is at its maximum position, i.e., near a maximum in flow capability. In an example where a bypass valve is not included, the maximum may be set at zero. The fuel flow offset used in block 5-12 is determined in block 5-20 by a difference between the current secondary fuel demand and the secondary fuel demand from the base engine loading control logic output from block 5-6. The offset may be stored in a memory, for example, a non-volatile memory 5-22 or the like so that it may be recalled after the controller is reset.

The demand schedule for fuel flow to the secondary stage may be determined, at least in part, from catalyst exit temperature T37 and used as feedback in block 5-16. The output of block 5-16 in this example is in the form of a preburner outlet temperature demand T34. Accordingly, block 5-18 performs closed loop control on the preburner outlet temperature T34 and outputs the secondary preburner fuel flow demand to the secondary fuel flow switch in block 5-14.

Figure 7:
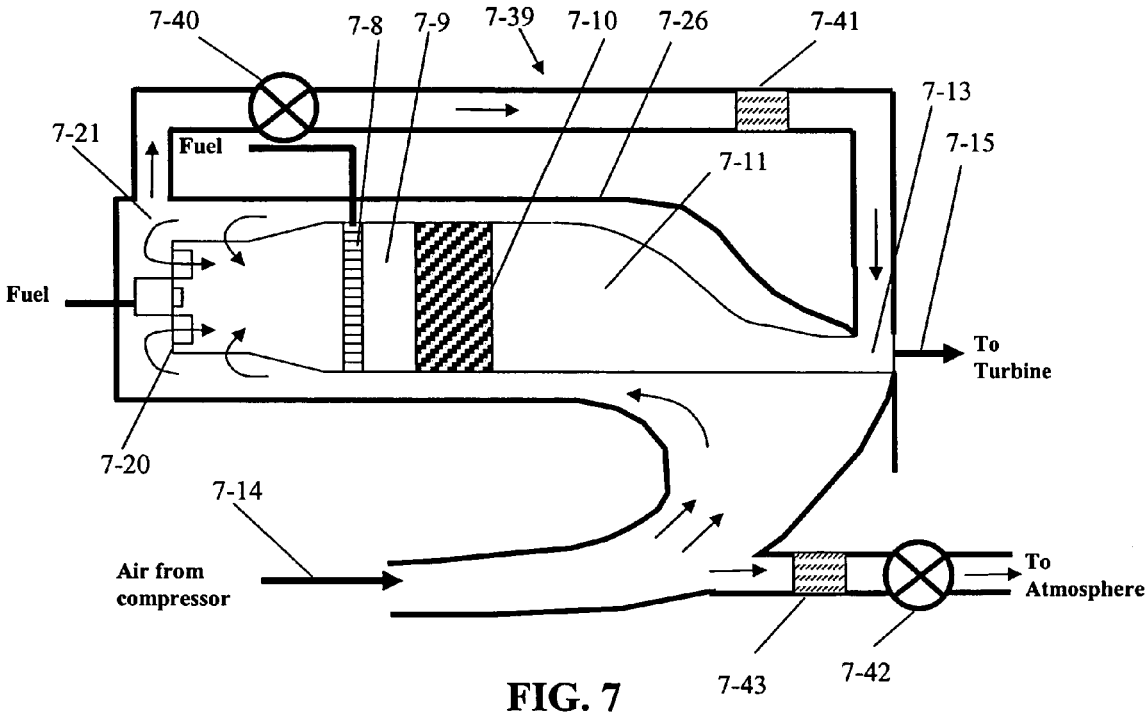
FIG. 7 illustrates an exemplary catalytic combustion system with a bypass valve and a bleed valve.

Closed loop control may similarly by used with a measure of the catalyst inlet temperature (not shown in FIG. 5). Further, the multiple combustor feedback process depicted in FIG. 5 may include bypass valve logic 5-8 to control bypass valves. An exemplary bypass valve process is depicted in FIG. 7.

The feedback control methods described may be implemented in hardware, firmware, and/or software suitable to carry out the various methods. For example, firmware commands or the like may be used to address various fuel valves and combustors.

According to another exemplary method, the fuel flow to each combustor may be matched to the airflow of each combustor. Specifically, the primary, second, and third stage fuel manifolds of the preburner may include fuel flow orifices that are configured to "match" the fuel flow to the combustor airflow. For example, a combustor with more airflow would have a larger fuel orifice and a combustor with less airflow would have a smaller fuel orifice. The fuel flow orifices may then be tuned during factory acceptance testing, commissioning, and the like to match the combustor airflow. Tuning the fuel flow orifices may reduce the total number of fuel valves per combustor. For instance, in one example, a single fuel valve may be used for each pre-burner stage of each combustor. Closed loop temperature control on the pre-burner outlet temperature (or catalyst inlet temperature, etc.) measured from one combustor may be the same or similar for all combustors in the system. Closed loop temperature control of one combustor may therefore be used to similarly control all of the combustors based on the measurements of one combustor. Further, control may be based on a global measurement or characteristic of the system, for example, the emission levels or exhaust temperature of the system. In this example, however, there may still be combustor-to-combustor variation in mass flow because of the varying air and fuel flows to each combustor. In some instances, however, the range of minimum to maximum mass flow across the multiple combustors after tuning the fuel orifices may be too large leading to the performance of the maximum mass flow combustors barely meeting CO emissions limits and the minimum mass flow combustor nearly overheating the catalyst. In this case, the minimum and maximum combustor would be monitored and controlled. For example, increase T34/bypass flow until the minimum catalyst combustor is at its maximum temperature and then decrease T34/bypass flow until the maximum catalyst module is at its minimum temperature or until the bulk CO measurement rises.

Alternatively, according to another exemplary method, the airflow may be matched to the fuel flow to the combustor. For example, the pre-burner dilution holes could be "tuned" in a manner similar to matching the fuel manifold orifices in the previous example. Varying the size, shape, etc. of the dilution holes allows the airflow through the combustor to be varied. In this instance, the pre-burner may include tunable or adjustable dilution holes that may be designed, for example, to ensure that by tuning the dilution holes, i.e., opening and/or closing dilution holes, the aerodynamic and structural performance of the pre-burner are not compromised. The dilution holes may include, for example, a plurality of holes, an orifice that may be constricted, vanes to divert airflow, and the like. Closed loop temperature control on the pre-burner outlet temperature, for example, for any one combustor may be the same for all combustors in the system such that all the combustors may be controlled based on the closed loop temperature control of the one combustor. Unlike the previous example, which included tuning the fuel orifices to match the fuel flow to the airflow, tuning the airflow to match the fuel flow should result in similar mass flows from combustor-to-combustor.

II. Homogeneous Combustion in the Burnout Zone:

According to another aspect of the invention, multi-combustor catalytic combustion control methods and systems are provided to ensure uniform combustor-to-combustor homogeneous combustion in the burnout zone.

With reference again to FIG. 3, a linear schematic representation of a simplified partial combustion catalytic system is illustrated with the gas temperature and fuel concentrations at various locations along the flow path shown there below. Air 3-7 enters combustor 3-26 and passes through a fuel injection and mixing system 3-8 that injects fuel into the flowing air stream. A portion of the fuel is combusted in the catalyst 3-10 resulting in an increase in temperature of the gas mixture as it passes through catalyst 3-10. As can be seen, the mixture exiting catalyst 3-10 is at an elevated temperature. This fuel/air mixture contains remaining unburned fuel that undergoes auto-ignition in the post catalyst burnout zone 3-11. The burnout zone 3-11 includes the portion of the flow path downstream of the catalyst but prior to introduction of additional air and before the turbine where the gas mixture exiting the catalyst may undergo further reaction. The fuel is combusted in the burnout zone 3-11 to form final reaction products including $CO_2$ and $H_2O$ with the temperature rising to the final combustion temperature 3-31 at homogeneous combustion process wave 3-30 (the region where the remaining uncombusted fuel exiting the catalyst is combusted). The resulting hot, high-energy gases in burnout zone 3-11 may drive the power turbine and load (e.g., 1-4 and 1-5 in FIG. 1).

The lower portion of FIG. 3 illustrates a graph with the gas temperature indicated on the ordinate and the position along the combustor, or flow path through the combustor, indicated on the abscissa. The position of the graph corresponding generally to the linear combustor diagram directly above it. As can be seen, the gas temperature increases as the mixture passes through catalyst 3-10 and a portion of the mixture combusts. Downstream of catalyst 3-10, however, the mixture temperature is constant for a period, typically referred to as the ignition delay time 3-32, $t_{ignition}$, before the remaining fuel combusts to form the homogeneous combustion process wave 3-30. The combustion of the mixture in the burnout zone 3-11 thereby further raises the gas temperature.

Homogeneous combustion in the burnout zone is primarily determined by the ignition delay time of the gas exiting the catalyst. The ignition delay time and catalyst exit conditions may be controlled such that the position of the homogeneous combustion process wave can be moved and maintained at a desired location or range of locations within the post catalyst reaction zone. The location of the homogeneous combustion process wave 3-30 may therefore be moved by changing, for example, the gas composition, pressure, catalyst outlet/exit temperature, and the adiabatic combustion temperature. For example, by increasing the catalyst outlet temperature to move the location of the homogeneous combustion process closer to the catalyst or decreasing the catalyst outlet temperature to move it farther downstream from the catalyst. In this way, the present control system advantageously keeps the catalyst operation across multiple combustors within a desired operating regime for good catalyst durability while maintaining low emissions. Specifically, when operating in such a regime, emissions of NOx, CO, and unburned hydrocarbons may be reduced while the durability of the catalysts maintained.

In one example, the homogeneous combustion wave is located just downstream of the catalyst but is not so far downstream that a long reaction zone or volume is required of the combustor. Ignition delay time depends, at least in part, on the gas composition (i.e., fuel-to-air mixtures), gas pressure within the combustor, catalyst exit gas temperature, and adiabatic combustion temperature (the temperature of a fuel and air mixture after all of the fuel in the mixture has been combusted with no thermal energy lost to the surroundings). Of these four parameters, the latter two in particular, catalyst exit gas temperature and adiabatic combustion temperature, may be adjusted in real time by an exemplary control system to change the ignition delay within each combustor and compensate for variations from combustor-to-combustor across the system.

The parameters affecting the ignition delay time may be broken down into discreet variables such as combustor airflow, catalyst fuel flow, pre-burner fuel flow, combustor inlet temperature, pre-burner efficiency, and catalyst activity. Some of these variables may be controlled or impacted by the exemplary pre-burner control strategies discussed previously. For example, controlling the fuel flow to the preburner based on closed loop temperature control of the preburner outlet temperature may be used to control the ignition delay time. Additional pre-burner control strategies that impact these variables will be discussed below as well as exemplary methods for controlling the catalyst fuel flow and combustor airflow.

FIGS. 4A, 4B, and 4C illustrate a homogeneous combustion process wave 4-30 at three different locations, as follows. In accordance with one exemplary method, the conditions within the gas turbine catalytic combustor system are controlled such that the position of homogeneous combustion process wave 4-30 (similar to 3-30 of FIG. 3) can be maintained in a desired location within the post catalyst reaction zone. FIG. 4A illustrates the homogeneous combustion wave 4-30 positioned at a desired location downstream of catalyst 4-10 with the actual location of combustion wave 4-30 controlled by the magnitude of the ignition delay time, $t_{ignition}$, (refer to FIG. 3). As the ignition delay time, $t_{ignition}$, is made longer, homogeneous combustion wave 4-30 moves downstream toward turbine 4-4 as shown in FIG. 4B. If homogeneous combustion wave 4-30 moves too close to turbine 4-4, then the remaining fuel and carbon monoxide may not fully combust and the emissions will be high. As such, FIG. 4B illustrates a less-desirable location for combustion wave 4-30. Conversely, as ignition delay time, $t_{ignition}$, is decreased, homogeneous combustion wave 4-30 moves toward catalyst 4-10 and the unburned portions of the fuel will have sufficient time to combust, thereby producing low emissions of hydrocarbons and carbon monoxide as shown in FIG. 4A. However, ignition delay time, $t_{ignition}$, is preferably not reduced to the extent that homogeneous combustion wave 4-30 moves too close to catalyst 4-10 as shown in FIG. 4C (or inside catalyst 4-10), because this may expose catalyst 4-10 to temperatures too high for efficient catalyst operation and may result in reducing the catalyst durability. As such, FIG. 4C illustrates a location for combustion wave 4-30 that may damage or reduce the operation of catalyst 4-10.

In accordance with one example, the multi-combustor catalytic system may be controlled to achieve uniform position of the homogeneous combustion wave 4-30 from combustor-to-combustor. The position may be maintained within a desired range by operating the system based on a predetermined schedule, wherein a predetermined or calculated schedule is based, at least in part, on the operating conditions of the catalytic combustor and/or the catalyst performance. Schedules may be based on operating ranges generated from theoretically based models or actual tests of the combustors in subscale or full scale test systems. For example, a predetermined operating schedule is described in previously referenced U.S. patent application Ser. No. 10/071,749. It should be recognized by those skilled in the art that various other methods for determining a desired operating range and schedule are possible.

In several exemplary methods, control of the position of the homogeneous combustion wave 4-30 is achieved by controlling the percentages (and, optionally, the total amount) of fuel sent to the preburner (e.g., fuel line 2-24 and preburner 2-20 of FIG. 2) and the catalyst fuel injection and mixing system (e.g., fuel line 2-25 and fuel injection system 2-8 of FIG. 2). For example, adding fuel to 2-24 bums more fuel in the preburner 2-20 and increases the temperature of the gas mixture at location 2-9, the catalyst inlet. This raises the temperature at the catalyst outlet and moves the homogeneous combustion wave 4-30 upstream. Adding fuel at 2-8 changes the fuel/air ratio at 2-9 and also shifts the homogeneous combustion wave 4-30 upstream. Further, control of the position of the homogeneous combustion wave 4-20 may be achieved by controlling the airflow of the combustors with a bypass system or bleed valves. The following are several exemplary methods for controlling and ensuring more uniform combustor-to-combustor homogeneous combustion in the burnout zone.

III. Control of Catalyst Fuel Flow to Each Combustor:

In one exemplary control method, each combustor includes a catalyst fuel valve that may be operated to control the fuel flow to the catalyst of each combustor and thereby control or influence the location of the homogeneous combustion wave. Closed loop feedback control on an ignition delay calculation may be used to control the fuel valve and fuel supply to the catalyst of each combustor. The ignition delay calculation may be based, at least in part, on a measure of the catalyst inlet gas temperature, catalyst exit gas temperature, catalyst fuel flow, or combustor airflow, and the like.

Figure 6:
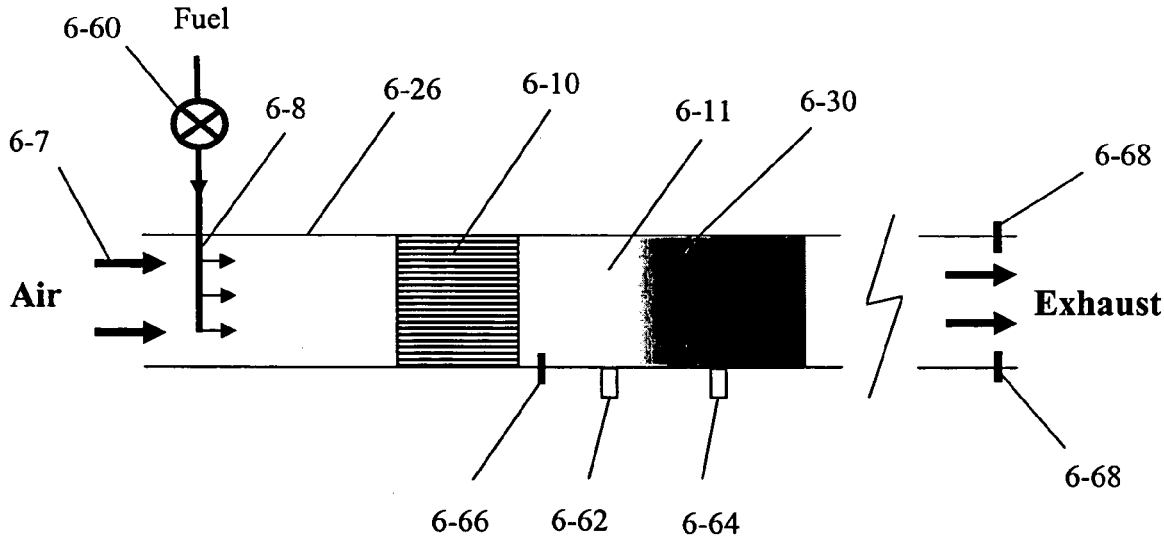
FIG. 6 illustrates an exemplary catalytic combustion system with UV sensors and a thermocouple sensor.

FIG. 6 illustrates an exemplary linear schematic representation of a combustor 6-26 including a controllable fuel valve 6-60. The system may control and alter the catalyst fuel flow to each combustor 6-26 via catalyst fuel valve 6-60 thereby controlling the position of the homogeneous combustion wave 6-30 in the burnout zone 6-11. In particular, the fuel flow to the catalyst 6-10 through fuel valve 6-60 may be controlled, for example, by a feedback measurement of the catalyst inlet or catalyst exit temperature thereby controlling the homogeneous combustion wave 6-30.

In one exemplary method, the catalyst fuel flow is determined by closed loop feedback control based on a catalyst exit gas temperature measurement. For example, a temperature probe 6-66, such as thermocouple, may be located down stream of catalyst 6-10 and measure the catalyst exit gas temperature. The fuel to the catalyst may be controllably varied based on the feedback from temperature probe 6-66. In one example, other variables that may impact the ignition delay time, such as airflow and the like, are substantially consistent across different combustors.

Additionally, the catalyst fuel flow control method may include a fuel trim feature wherein small incremental increases in catalyst fuel flow are made until homogeneous combustion is established in each combustor 6-26. In one example, homogeneous combustion may be confirmed in each combustor 6-26 based on UV-sensor feedback. For example, as illustrated in FIG. 6, combustor 6-26 may include two UV-sensors 6-62 and 6-64 that may be used to determine if homogeneous combustion has been established as well as the location of the homogeneous combustion wave 6-30 (see FIGS. 9A–9D). It should be recognized that various other means and devices may be used to establish homogeneous combustion in each combustor 6-26 such as thermocouples or exhaust uniformity measurements.

In another exemplary method, the exhaust gas temperature and pattern factor, i.e., the relative uniformity of the exhaust gas temperature, may be used as feedback to control the catalyst fuel flow to each combustor 6-26. Thermocouples 6-68 may be disposed circumferentialy around the turbine axis and downstream of the turbine section to measure the exhaust gas temperature pattern. In a typical multi-combustor application, the pattern factor or relative uniformity of the exhaust gas temperature thermocouples 6-68 of a properly instrumented exhaust may be used to determine the relative exit temperature of each combustor. The specific correlation from the circumferential location of the exhaust gas temperature thermocouple to the circumferential location of the combustor depends on the engine design. Combustors with exit temperatures below a predetermined temperature are not "lit," i.e., do not have homogeneous combustion, while combustors with exit temperatures above a predetermined temperature are "lit." In the case with catalytic combustion, the combustors with relatively lower exit temperatures most likely do not have homogeneous combustion and the combustors with higher exit temperatures most likely have homogeneous combustion established. Therefore, the feedback method may adjust the catalyst fuel flow to the specific combustor corresponding to the low exhaust gas temperature until the pattern factor becomes more uniform indicating homogenous combustion. This method may be used to control all of the catalyst fuel flow or merely as a fuel trim feature which may only allow minor adjustments to the catalyst fuel flow until homogeneous combustion is established.

An additional method, which may be used in conjunction with closed loop feedback control based on a UV-sensor, exhaust gas temperature measurement, and the like, includes further controlling the system with a temporary open loop control to establish or extinguish homogeneous combustion in the multiple combustors 6-26. For example, when homogeneous combustion is established (or extinguished) in one combustor 6-26, the catalyst fuel valves 6-60 may temporarily operate in open loop control to ramp fuel up (or down) in a fixed ramp rate manner through the homogeneous combustion transition. Once homogeneous combustion is established (or extinguished) in all of the combustors as indicated by the UV-sensors, exhaust gas temperature, or the like, any of the closed loop methods to control the catalyst fuel valve 6-60 flow may resume as described.

IV. Control of Airflow to Each Combustor:

In another aspect of the invention, airflow through each preburner and/or combustor may be controlled to vary the ignition delay time and the location of the homogeneous combustion wave within each combustor. For example, varying the airflow based on closed loop feedback control of a characteristic of the preburner, combustor, engine, and the like may be used to adjust the airflow and control multiple combustors.

In one exemplary method, airflow through each combustor may be controlled via a bypass valve or a bleed valve to vary the ignition delay time and the location of the homogeneous combustion wave within each combustor. The bypass or bleed valves may perform closed loop feedback control based on the feedback strategies described for the various catalyst fuel flow control methods and systems, including measurements of ignition delay, UV-sensors, catalyst exit gas temperature, pattern factor of the exhaust gas temperature, and the like. The bypass or bleed valves may further employ temporary open loop control methods as described for the catalyst fuel control method.

Other methods for managing and varying the airflow through the preburners and combustors are possible, and this aspect of the invention should not be limited to any particular device or method described herein. For example, varying inlet guide valves or the like may be, advantageously used to alter the airflow through a combustor.

An exemplary bypass system is illustrated in FIG. 7. The bypass system 7-39 extracts air from a region 7-21 near the preburner 7-20 inlet and injects the air in a region 7-13 downstream of the post catalyst reaction zone 7-11 but upstream of the power turbine inlet 7-15. Bypass air can also be extracted at the outlet of the compressor, at any location between the compressor outlet and the preburner 7-21, or downstream of the preburner 7-20. Flow meter 7-41 may measure the bypass airflow and valve 7-40 may control the bypass airflow. The bypass flow from region 7-21 to region 7-13 is driven by the pressure difference with region 7-13 at a lower pressure than region 7-21. This pressure difference is due to the pressure drop that occurs through the combustor including the preburner 7-20, the catalyst fuel injector 7-8, and the catalyst 7-10. The bypass system 7-39 allows for the control of the ignition delay of the gas exiting the catalyst by controlling the combustor airflow. The bypass system 7-39 may thereby control the homogeneous combustion in the burnout zone 7-11 of each combustor 7-26.

The amount of bypass air may affect the amount of emissions produced by the system. For example, at a given engine load condition with zero bypass airflow high emissions of CO may result from either a long ignition delay or from a low final combustion temperature. At the same load condition but with bypass airflow, the higher fuel to air ratio in the combustor will decrease the ignition delay time and raise the final combustion temperature. The higher combustion temperature will also act to oxidize the CO more rapidly. This process may lower the emissions of the system. Power output by the engine and engine efficiency remains unchanged because the bypass air is re-injected at 7-13, which maintains the total gas mass flow through the drive turbine and also lowers the combustor exit temperature to the same combustor exit temperature achieved in the zero bypass airflow case.

FIG. 7 also illustrates an exemplary bleed system for combustor 7-26. The bleed system extracts air from a region near the compressor discharge 7-14 and vents it to the atmosphere. A flow meter 7-43 may measure the flow of bleed air and valve 7-42 may control flow of bleed air. The bleed flow from 7-14 to atmosphere is driven by a pressure difference with 7-14 being higher pressure than atmosphere pressure.

The amount of bleed airflow may also be controlled to reduce emissions. For example, under conditions where bleed airflow is non-zero, the final combustion outlet temperature is higher than where bleed airflow is zero. The final combustor outlet temperature is higher because the fuel is combusted in less air and because more fuel must be added to maintain turbine power output with reduced mass flow through the power turbine. The higher combustion temperature compensates for the power loss resulting from the bleed airflow so the net power output by the system remains substantially unchanged. The result of bleed air on emissions is the same as the result of bypass air on emissions.

The gas turbines with multiple combustors may also include inlet guide vanes (not shown) to vary the amount of airflow through the engine and combustor. Inlet guide vanes generally include a set of vanes disposed at the inlet of the compressor that may be rotated to reduce the airflow into the compressor and therefore the total airflow through the system. The inlet guide vanes may be used to reduce airflow and increase the fuel to air ratio within the combustor to stay within a desired operating range.

Figure 8:
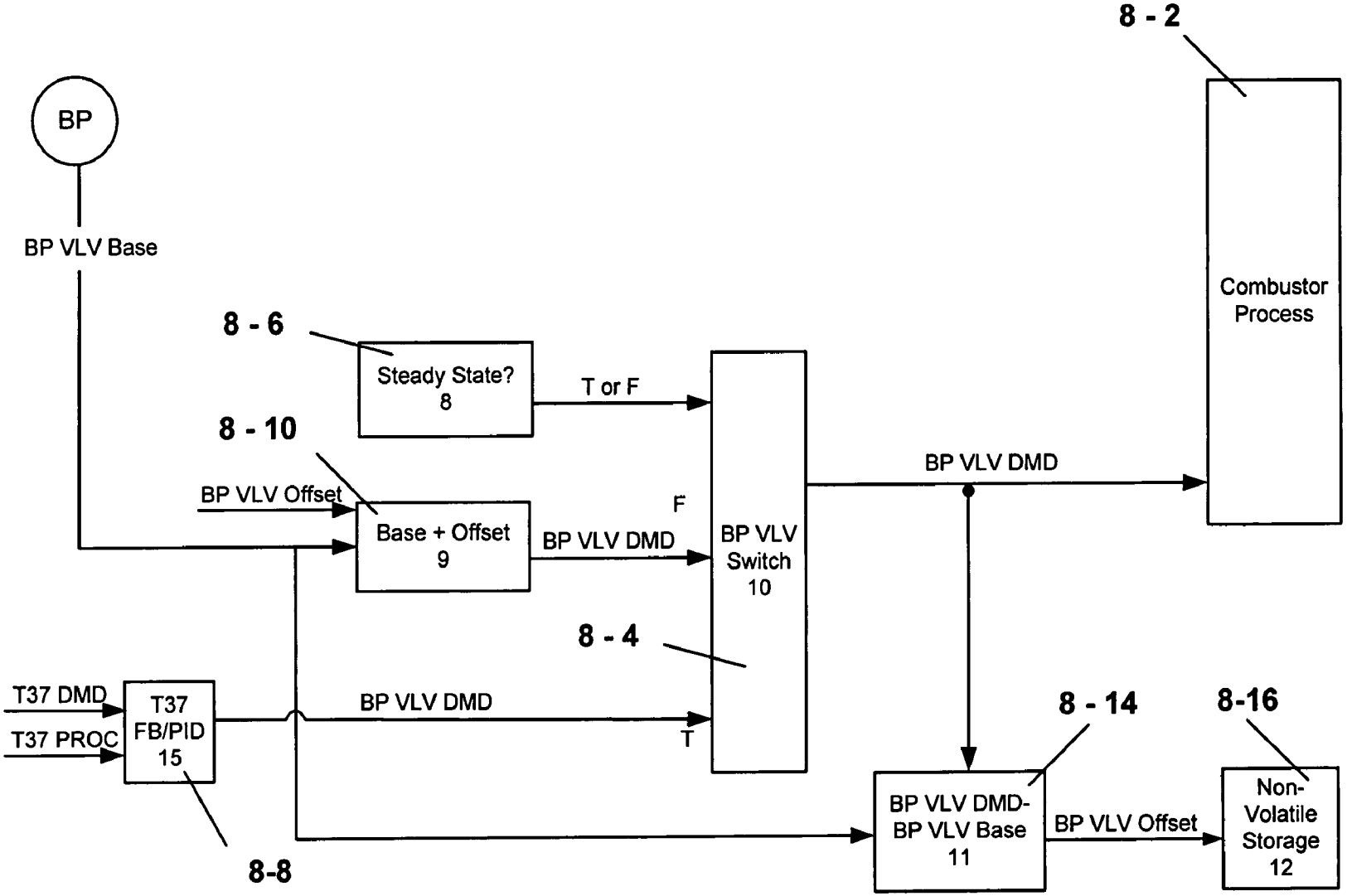
FIG. 8 illustrates an illustrates an exemplary control method for a multiple combustor system.
Figure 9A:
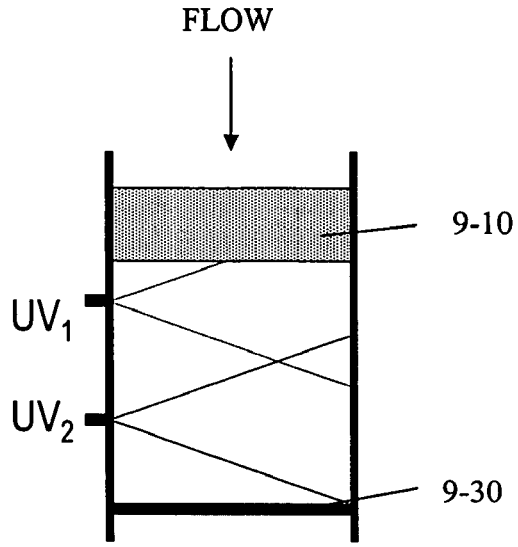
FIGS. 9A–9D illustrate exemplary operation of a combustor system with UV sensors.
Figure 9C:
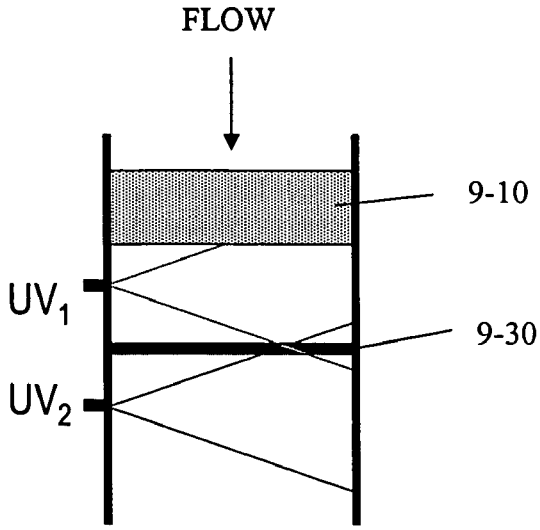
Figure 9B:
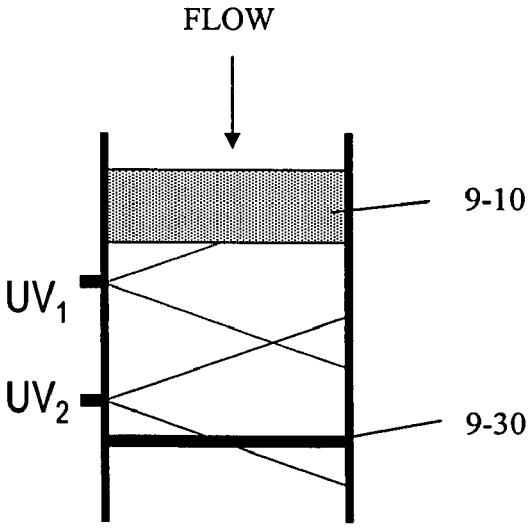
Figure 9D:
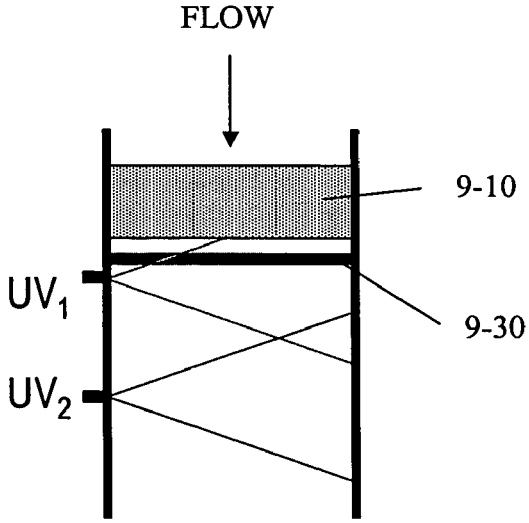

An exemplary control method including a bypass valve system and/or a bleed valve system is illustrated in FIG. 8. The bypass and/or bleed valves of the multi-combustor process 8-2 receives a bypass valve demand schedule from a bypass valve switch logic block 8-4 based on inputs from various inputs, such as temperature measurements, fuel flow and/or airflow calculations, and the like. Block 8-4 acts as a switch for the bypass and/or bleed valve and determines the bypass and/or bleed valve demand based on a determination of whether or not the process is operating in a steady state determined in block 8-6. If the process is operating in a steady state the bypass and/or bleed valve demand schedule is determined by feedback block 8-8. Feedback block 8-8 performs closed loop control on the catalyst exit temperature T37 and outputs a bypass and/or bleed valve demand to block 8-4 based on the demand schedule. It should be recognized that the feedback control might be based on other factors such as airflow through the combustor, catalyst inlet temperature, and the like.

If the process is not operating in a steady state as determined by block 8-6, the bypass and/or bleed valve demand is determined by block 8-10. Block 8-10 determines a bypass and/or bleed valve demand based upon a bypass valve base value and a bypass valve offset. The bypass and/or bleed valve offset used in block 8-10 is determined in block 8-14 by a difference between the current bypass and/or bleed demand and the bypass and/or bleed demand from the base engine loading control logic output from the bypass valve base. The offset may then be stored in a memory in block 8-16, for example, a non-volatile memory or the like so that it may be recalled in the event the controller is reset.

Closed loop control may similarly be used with a measure of the catalyst inlet temperature as well as other measurements of the system (not shown in FIG. 8). For example, in a further exemplary method, a dual UV-sensor feedback control system as illustrated in FIGS. 9A–9D may be used to control a bypass valve, bleed valve, fuel valve, or other variable that determines the position of the homogeneous combustion wave. In this particular example, two axially located UV sensors ($UV_1$, and $UV_2$) are positioned downstream of catalyst 9-10 such that the ideal location for the homogeneous combustion wave 9-30 would be between $UV_1$, and $UV_2$. The ideal location for homogeneous combustion wave 9-30 may be based on desired emissions levels, catalyst durability, and the like. If both $UV_1$ and $UV_2$ measure signals below a first threshold, indicating that the homogeneous combustion wave 9-30 is not within view of either UV sensor then the bypass/bleed valves may be opened to increase the temperature exiting catalyst 9-10 and bring the homogeneous combustion wave 9-30 closer to the catalyst 9-10 (see FIG. 9A). For example, the threshold may be 4 mA where the sensors measure a signal of approximately 6 mA if the homogeneous combustion wave 9-30 is in view. If $UV_2$ measures a high signal but $UV_1$ continues to measure a low signal, then bypass/bleed valves may continue to open and bring the combustion wave 9-30 further upstream towards catalyst 9-10 (see FIG. 9B). If both $UV_1$ and $UV_2$ measure high signals, the combustion wave 9-30 should be in the ideal location between each sensor (see FIG. 9C). If $UV_2$ measures a low signal but $UV_1$ measures a high signal, then the combustion wave 9-30 is too close to catalyst 9-10 and the bypass/bleed valve would close an amount to move the wave 9-30 downstream (see FIG. 9D). The feedback control system may also be used with various fuel flow and preburner methods described herein to vary the fuel and airflow through the combustor or preburners.

Figure 10:
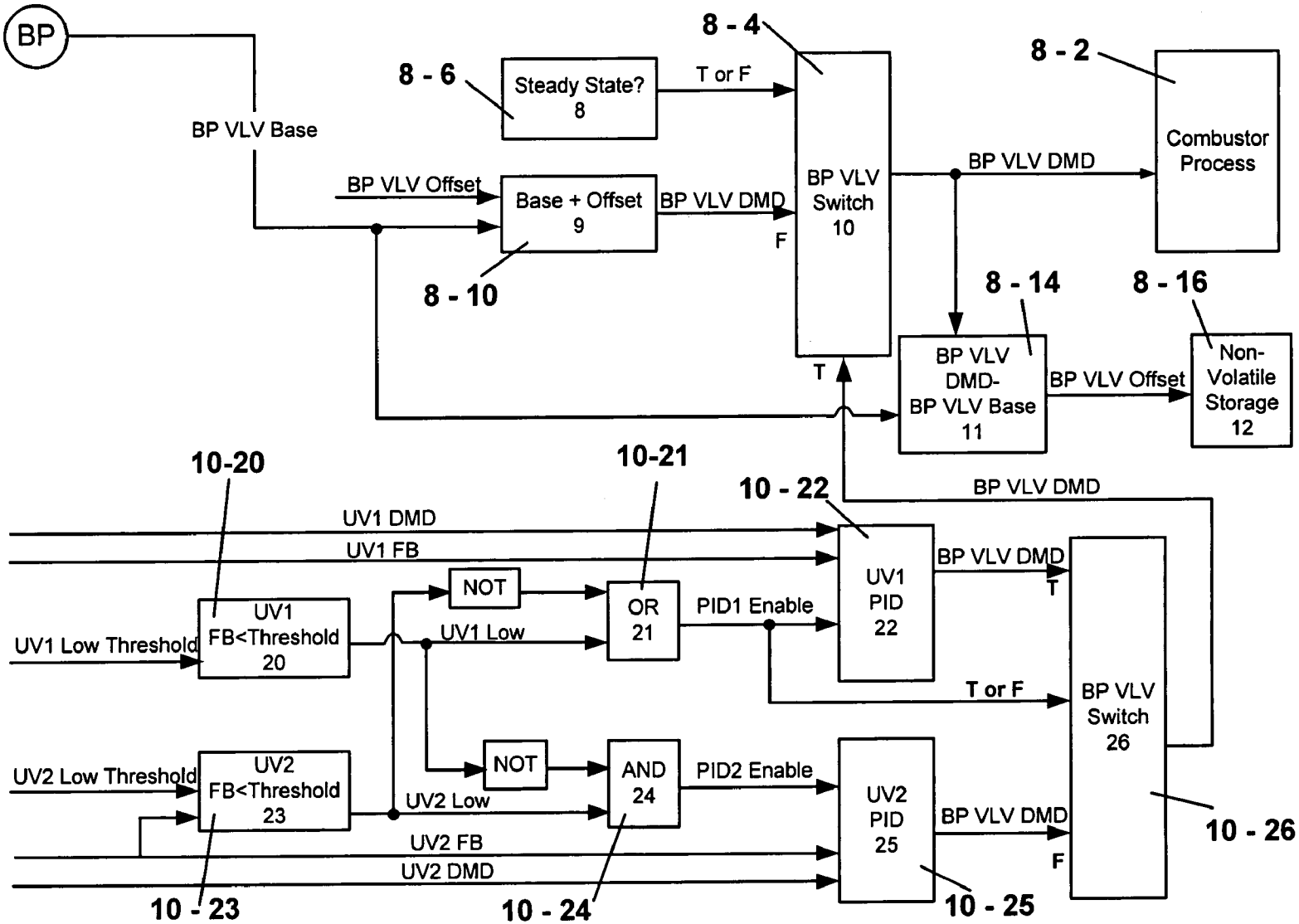
FIG. 10 illustrates an exemplary control method for a multiple combustor system.

A sample method of applying this strategy is shown in greater detail in FIG. 10. FIG. 10 is similar to FIG. 8 except that the bypass valve demand is determined when the process is in a steady state (see block 8-6) based on bypass valve switch 10-26. Bypass valve demand 10-26 is based upon readings from a first and second UV sensor, $UV_1$ and $UV_2$, substantially as described above.

Block 10-20 outputs logic TRUE if the output from $UV_1$ is less than a predetermined threshold, for example, less than 4 mA. Similarly, block 10-23 outputs logic TRUE if the output from $UV_2$ is less than a predetermined threshold. Logic OR and AND blocks 10-21 and 10-24 receive outputs from both blocks 10-20 and 10-23 and output to closed loop control blocks 10-22 and 10-25. Block 10-22 performs closed loop control on the $UV_1$ sensor output. The closed loop control on $UV_1$ sensor is only active when block 10-22 is active based on the output from block 10-21. The output of block 10-22 is the bypass valve demand. Block 10-25 operates in a similar manner as block 10-22 to output a bypass valve demand based on $UV_2$ output when enabled.

According to another exemplary method, variable geometry controlled dilution holes may be included on each combustor and controlled by a feedback method to vary the combustor airflow through each combustor. The method may operate in a similar manner as the bypass and bleed valve systems and methods described above except that the variable geometry system would vary the effective area of dilution holes to alter the airflow. The resulting range of airflow rate change achieved by varying the dilution holes, however, is generally less than that achievable by the bypass or bleed valve methods. A variable geometry method may be employed alone or in combination with any other control methods.

According to yet another exemplary method, the airflow to each combustor may be matched such that airflow through each combustor is substantially equal. Each combustor may include dilution holes that may be "tuned" or sized in relation to the size of the combustor in a manner similar to tuning the fuel manifold orifices of the preburner described above. Further, the design of the combustion system may include "tunable" or variable dilution holes to vary the airflow. In one example, the dilution holes do not compromise the aerodynamic and structural performance of the combustor when opening and/or closing the holes.

In methods including matching the airflow to each combustor closed loop control of fuel based on any of the feedback strategies previously discussed for any one combustor should be the same or similar for all the combustors. For example, measurements of ignition delay, UV-sensors, catalyst exit gas temperature, pattern factor of the exhaust gas temperature, and the like, for any one combustor should be the same or similar across all combustors in the system. Therefore, matching the airflow and fuel flow to each combustor, the combustor-to-combustor variations may be significantly reduced. As a result, the control approach of any one combustor should be similar, if not identical, for all combustors. The previously mentioned feedback sensors may be employed in one combustor or as a global sensor by lumping the performance of each combustor into one bulk measurement and used to control the multi-combustor system. For example, a global sensor feedback may include the bulk average of the exhaust gas emissions of CO and be used to control the airflow, fuel flow, and the like of all the combustors.

In other exemplary methods, the pre-burner may be controlled to perform closed loop feedback based on an ignition delay calculation such as catalyst inlet gas temperature, catalyst exit gas temperature, catalyst fuel flow, or combustor airflow. Additionally, the pre-burner output control strategy could have a trim feature (small incremental increases in the pre-burner output) until homogeneous combustion is established in each combustor based on UV-sensor feedback.

Figure 11:
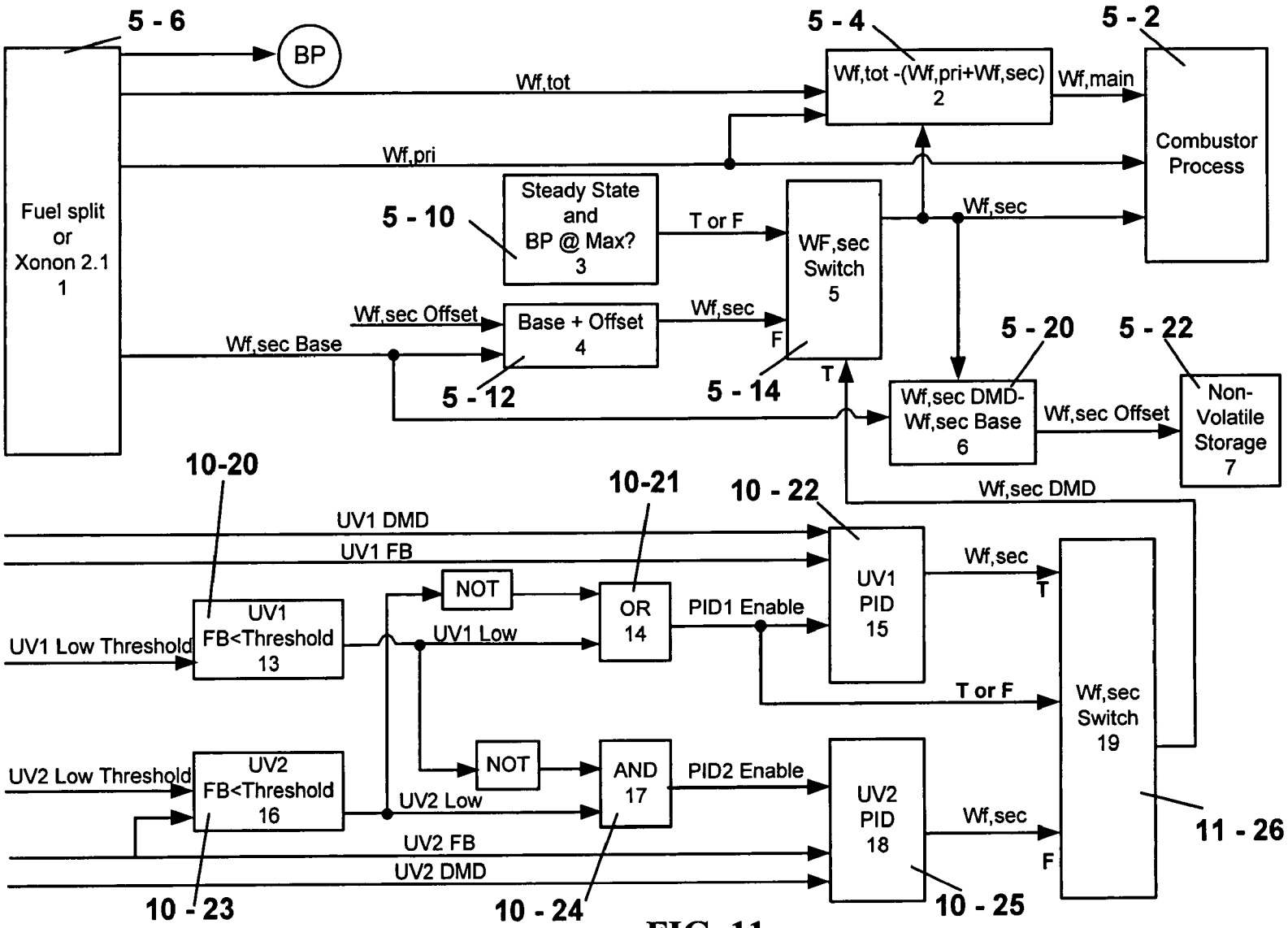
FIG. 11 illustrates an exemplary control method for a multiple combustor system.

Additionally, the pre-burner control method described above could utilize the dual UV-sensor feedback control method and system of FIGS. 9A–9D. In this example, the location for the homogeneous combustion wave 9-30 is desirably between two axially located UV sensors ($UV_1$ and $UV_2$). If both $UV_1$ and $UV_2$ measure low signals (i.e., below a threshold value), the pre-burner output may be increased to bring the homogeneous combustion wave 9-30 into view. If $UV_2$ measure a high signal (i.e., above a threshold value) but $UV_1$ continues to measure a low signal, then the preburner output may be further increased to bring the combustion wave 9-30 further upstream to the desired location between $UV_1$ and $UV_2$. If both $UV_1$ and $UV_2$ measure signals above the threshold value, the combustion wave 9-30 should be located in the ideal location. If $UV_2$ measures a low signal but $UV_1$ shows a high signal, then the combustion wave is too close to the catalyst 9-10 and the preburner output may be decreased to move the wave downstream. A sample method of applying this strategy is shown in FIG. 11. The method is similar to that of FIG. 10 further including functions for feedback control of the preburner fuel flow of FIG. 5. In particular, the feedback control logic is similar (blocks 10-20 through 10-25) with a secondary fuel flow block 11-26 determining the secondary preburner fuel demand.

In an example where the burnout zone is fitted with a flame holder to reduce the combustor size, the ignition delay calculation may prove less useful than previous examples, but still useful. In such a case, the flame holder temperature could be monitored by a thermocouple and a temperature rise between the flame-holder and catalyst exit temperature could suggest homogenous combustion has been established. This feedback approach could be applied to either catalyst fuel flow or bypass airflow control methods.

Figure 12:
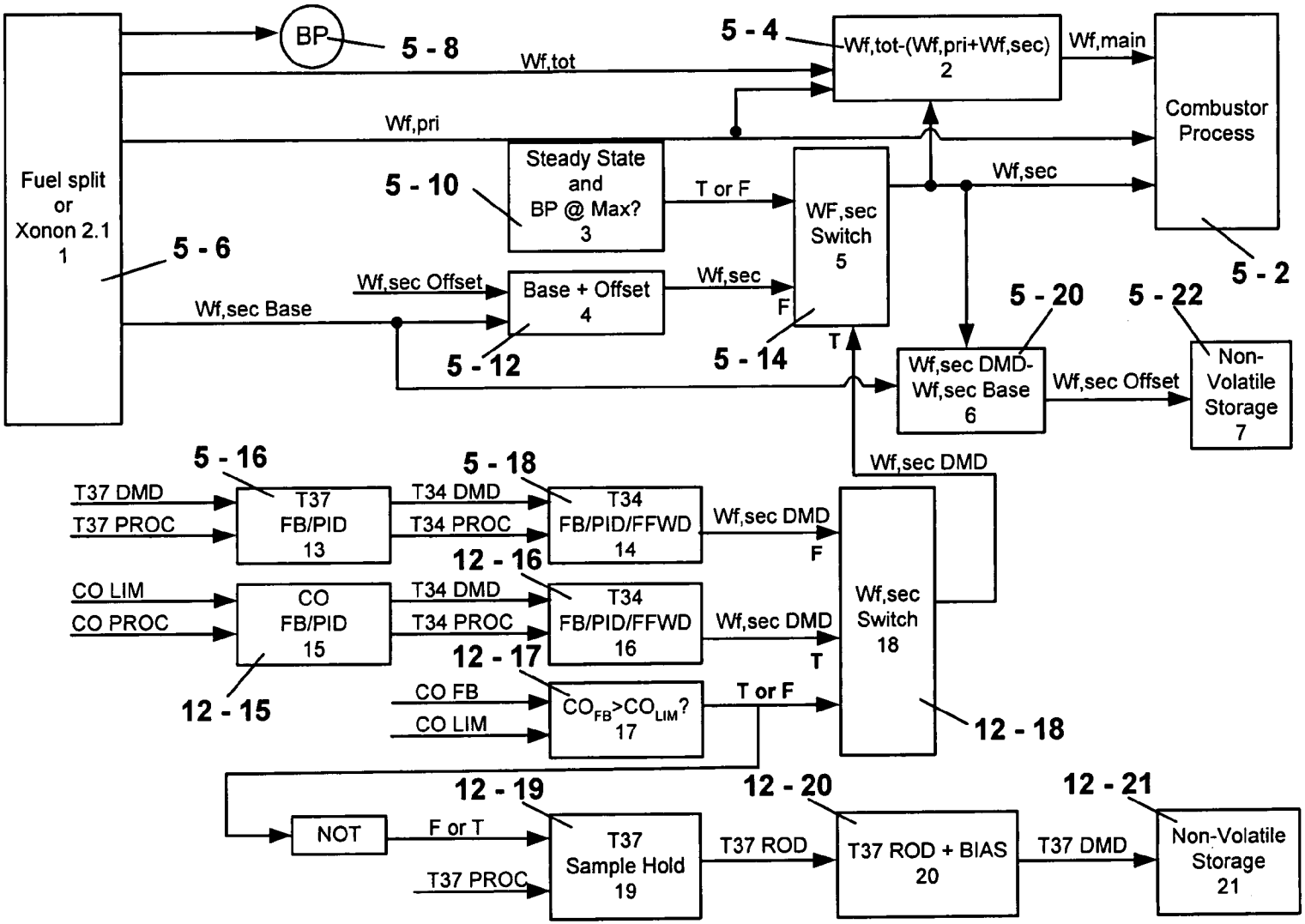
FIGS. 12 and 13 illustrate exemplary control methods for a multiple combustor system.
Figure 13:
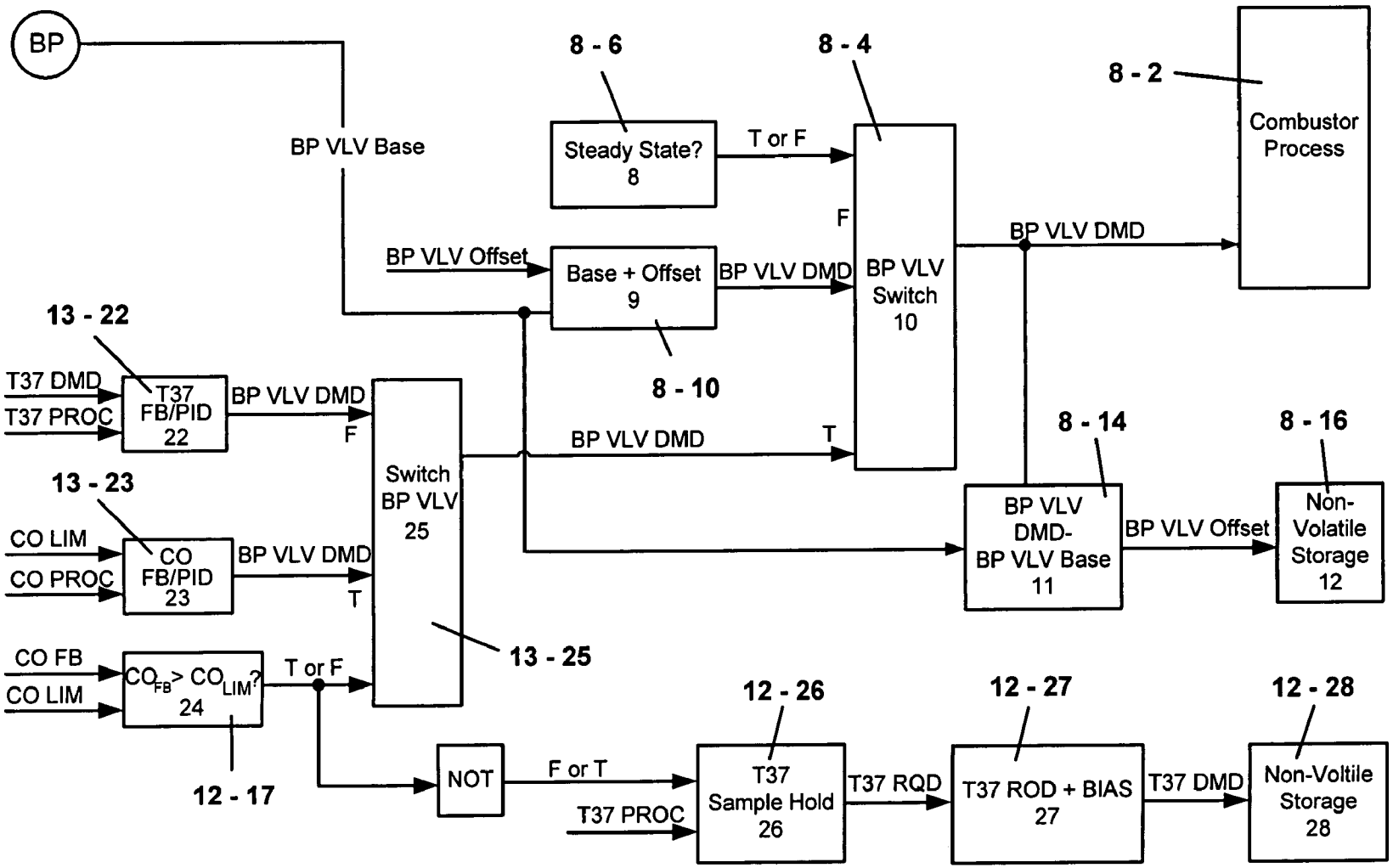

FIGS. 12 and 13 illustrate additional methods of controlling a multi-combustor system where feedback control may be based on the combined output of two or more sensor devices. For example, one control method is based on the combined output of the catalyst exit temperature T37 (i.e., a characteristic of an individual combustor) and a measure of CO emissions (i.e., a characteristic of the system). The preburner and bypass method may be controlled to optimize the combustion wave location and minimize CO emissions of the multi-combustor system. The combined sensor approach provides a global sensor feedback by measuring the combined CO emissions of all the combustors in the system. Further, the method provides individual combustor sensor feedback, for example, the catalyst exit temperature T37 of each combustor.

FIG. 12 operates in a manner similar to FIG. 5 except that the secondary preburner fuel demand is controlled based upon closed loop control of preburner outlet temperature and CO emissions when the system operates in steady state and the bypass valve is at a maximum (block 5-10). In particular block 12-18 outputs the secondary preburner fuel demand based on input from closed loop control on catalyst exit gas temperature T37 and preburner outlet temperature demand T34 in blocks 5-16 and 5-18 as described in regard to FIG. 5. Block 12-18 also receives input from closed loop control on CO emissions and preburner outlet temperature demand T34 in blocks 12-15 and 12-16 respectively. Switch 12-18 determines which input to output to switch 5-14 based on the measured CO emissions in block 12-17. If the emissions are above a limit or threshold, for example 5 ppm, switch 12-18 uses the secondary preburner fuel demand specified by the CO emissions feedback control in blocks 12-15 and 12-16.

In one example, the method further includes a sample hold process in block 12-19. When the CO output has satisfied the CO limit through CO emissions feedback control, a one-time snapshot or measurement of the catalyst exit gas temperature T37 may be output. The output of T37 represents the desired temperature to achieve low CO emissions performance. A pre-determined bias may then be added to the desired T37 as a buffer in block 12-20 and a catalyst exit gas temperature T37 demand output to block 12-21 and may be used as the updated T37 demand to block 5-16. The T37 demand output may be stored in non-volatile storage or the like in block 12-21.

FIG. 13 operates in a manner similar to FIG. 8 except that the bypass valve demand is controlled based upon closed loop control of catalyst exit temperature T37 and CO emissions when the system operates in steady state (block 8-6). Block 13-22 outputs a bypass valve demand based upon closed loop control on catalyst exit gas temperature T37 . Block 13-23 outputs a bypass valve demand based upon closed loop control on CO emissions. Block 12-17 operates by switching switch 13-25 based on a determination if the CO emissions have exceeded a pre-determined limit as discussed above. Further, the method may include a sample hold of the catalyst outlet gas temperature T37 in blocks 12-26, 12-27 and store the output in block 12-28.

The above detailed description is provided to illustrate various examples but is not intended to be limiting. It will be apparent to those skilled in the art that numerous modification and variations within the scope of the present invention are possible. Various control methods and systems described herein may be used alone or in combination. For example, an exemplary method for controlling the operation of the preburners may be used alone or in combination with a method to control the catalyst fuel flow or airflow through a combustor and vice versa. Other variations and combinations, as will be apparent to those skilled in the art, are possible and within the scope of the invention. Further, throughout this description, particular examples have been discussed and how these examples are thought to address certain disadvantages in related art. This discussion is not meant, however, to restrict the various examples to methods and/or systems that actually address or solve the disadvantages.

The invention claimed is:

1. A method of controlling a multi-combustor catalytic combustion system comprising the acts of:

determining a temperature downstream of a preburner associated with a catalytic combustor in a multi-combustor system, wherein the preburner includes two or more fuel stages and wherein fuel flow to the two or more fuel stages is determined based upon a fixed fuel split schedule during an ignition sequence; and adjusting the fuel flow to the preburner based on the temperature.

2. The method of claim 1, wherein the preburner includes a flame burner.

3. The method of claim 1, wherein the preburner includes one or more fuel orifices that are sized proportional to the airflow of the combustor.

4. The method of claim 1, wherein one or more fuel orifices supplying fuel to a catalyst of the catalytic combustor are sized proportional to the airflow of the combustor.

5. The method of claim 1, wherein the system includes at least a second preburner associated with at least a second catalytic combustor, and the fuel flow to each preburner is proportional to the airflow through each combustor.

6. The method of claim 5, wherein closed loop control on a single preburner is used to determine fuel flow to all preburners in the multi-combustor system.

7. The method of claim 1, wherein the act of adjusting the fuel flow to the preburner includes closed loop control on the preburner outlet temperature.

8. The method claim 1, wherein the act of adjusting the fuel flow to the preburner includes closed loop control on a catalyst inlet temperature.

9. The method of claim 1, wherein the act of adjusting the fuel flow to the preburner includes closed loop control on a catalyst outlet temperature.

10. The method claim 1, wherein the system includes at least a second preburner associated with at least a second combustor, and the act of adjusting the fuel flow to the preburner compensates for combustor-to-combustor variations.

11. The method of claim 10, wherein the combustor-to-combustor variations include a variation in at least one of preburner ignition delay, catalyst light-off temperature, and a position of homogeneous combustion in a burnout zone.

12. The method of claim 11, wherein the fuel flow is adjusted to vary the position of a homogeneous combustion wave in the burnout zone.

13. The method of claim 12, wherein the position of the homogeneous combustion wave in the burnout zone is determined by dual UV' sensors disposed in the burnout zone.

14. The method claim 1, further including the act of adjusting an airflow through at least one of the preburner and the combustor.

15. The method of claim 14, wherein the act of adjusting the airflow through at least one of the preburner and the combustor includes adjusting dilution holes in the preburner.

16. The method of claim 14, wherein the act of adjusting the airflow through at least one of the preburner and the combustor includes varying at least one of a bypass valve and a bleed valve associated with the combustor.

17. The method of claim 14, wherein in a closed loop fuel control, the preburner is used to determine fuel flow to at least a second preburner associated with at least a second combustor.

18. A method of controlling a multi-combustor catalytic combustion system comprising the acts of:

varying at least one of a fuel flow and an airflow to a plurality of combustors; and controlling the location of a homogeneous combustion wave in each of the plurality of catalytic combustors.

19. The method of claim 18, wherein the fuel flow or the airflow is varied based upon feedback from an ignition delay calculation.

20. The method of claim 18, wherein the fuel flow is varied based upon feedback from at least one of a measure of a catalyst inlet gas temperature, catalyst exit gas temperature, and combustor airflow.

21. The method of claim 18, wherein the airflow is varied based upon feedback from at least one of a measure of a catalyst inlet gas temperature, catalyst exit gas temperature, and combustor fuel flow.

22. The method of claim 21, wherein the airflow to each combustor is varied by a bypass valve.

23. The method of claim 21, wherein the airflow to each combustor is varied by a bleed valve.

24. The method of claim 18, wherein at least one of the fuel flow and the airflow is varied based upon feedback from two W sensors placed in the burnout zone of at least one combustor.

25. The method of claim 24, wherein at least one of the fuel flow and the airflow is varied based upon feedback from two sets of two UV sensors placed in the burnout zone of two combustors.

26. The method of claim 25, wherein the two combustors include a minimum mass flow combustor and a maximum mass flow combustor of the plurality of combustors.

27. The method of claim 18, wherein at least one of the fuel flow and the airflow is varied based upon feedback from a measure of the relative uniformity of the exhaust gas temperature.

28. The method of claim 18, wherein at least one of a fuel flow and an airflow to a preburner is varied, the preburner being associated with at least one of the catalytic combustors.

29. The method of claim 18, wherein at least one of a fuel flow and an airflow to the catalyst is varied.

30. A method of controlling a multi-combustor catalytic combustion system comprising the acts of:

determining a first characteristic of operation for at least one combustor in a multi-combustor system;

determining a second characteristic of operation for the multi-combustor system; and controlling the system based upon feedback from the first characteristic and the second characteristic, wherein the first characteristic includes the position of a homogenous combustion wave.

31. A method of controlling a multi-combustor catalytic combustion system comprising the acts of:

determining a first characteristic of operation for at least one combustor in a multi- combustor system;

determining a second characteristic of operation for the multi-combustor system; and controlling the system based upon feedback from the first characteristic and the second characteristic, wherein the second characteristic includes a measure of CO emissions.

32. The method of claim 31, wherein the second characteristic includes a measure of CO emissions from all combustors in the multi-combustor system.

* * * * *